US006146271A

United States Patent [19]

Kadlic

[11] Patent Number: 6,146,271

[45] **Date of Patent: *Nov. 14, 2000**

[54] MULTIPLE PLAY PICK ONE POKER

[76] Inventor: Thomas P. Kadlic, 4505 W. Hacienda Ave., Suite #G, Las Vegas, Nev. 89118

[ * ] Notice: This patent is subject to a terminal disclaimer.

[21] Appl. No.: 09/238,961

[22] Filed: Jan. 27, 1999

Related U.S. Application Data

[63] Continuation-in-part of application No. 09/056,898, Apr. 7, 1998, which is a continuation of application No. 08/850,625, May 2, 1997, Pat. No. 5,816,915.

[51] Int. Cl.[7] ..... A63F 1/00

[52] U.S. Cl. ..... 463/13; 273/292

[58] Field of Search ..... 273/292, 274, 273/309; 463/12, 13

[56] References Cited

U.S. PATENT DOCUMENTS 5,732,950 3/1998 Moody ..... 273/292
5,816,915 10/1998 Kadlic ..... 463/13

*Primary Examiner*—Benjamin H. Layno

*Attorney, Agent, or Firm*—Quirk & Tratos

[57] ABSTRACT

An electronic video draw poker machine is provided with a multi-hand screen display that can show a plurality of five card draw poker hands. A separate five card poker hand is displayed in each quadrant of the screen display with each five card hand being dealt from its associated, separate deck of playing cards. The initial deal of each five card hand is two cards face up and three cards face down. The player selects one of the sets of two face up cards to continue play. After the player has selected which set of two face up cards he wishes to play, the selected two face up cards are duplicated into the other three hand positions to replace the two face up cards in that hand position. The remaining face down cards in each hand are then revealed. The game then continues in the conventional manner with the player discarding and drawing replacement cards with respect to each of the four separate five card hands in an attempt to improve each hand. After the draw step is completed, each of the final five card hands are compared to a pay table based on poker hand ranking to determine if the player has achieved a winning combination. The amount of the payout to the player for a winning combination is based on the number of coins, tokens or credits wagered by the player and the type of winning hand achieved.

11 Claims, 7 Drawing Sheets

| | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR ACES | 80 | 160 | 240 | 320 | 400 |
| FOUR 2's, 3's or 4's | 40 | 80 | 120 | 160 | 200 |
| FOUR 5's THRU KINGS | 20 | 40 | 60 | 80 | 100 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

| | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR ACES | 80 | 160 | 240 | 320 | 400 |
| FOUR 2's, 3's or 4's | 40 | 80 | 120 | 160 | 200 |
| FOUR 5's THRU KINGS | 20 | 40 | 60 | 80 | 100 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

| | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR ACES | 80 | 160 | 240 | 320 | 400 |
| FOUR 2's, 3's or 4's | 40 | 80 | 120 | 160 | 200 |
| FOUR 5's THRU KINGS | 20 | 40 | 60 | 80 | 100 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

| | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR ACES | 80 | 160 | 240 | 320 | 400 |
| FOUR 2's, 3's or 4's | 40 | 80 | 120 | 160 | 200 |
| FOUR 5's THRU KINGS | 20 | 40 | 60 | 80 | 100 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

| | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR ACES | 80 | 160 | 240 | 320 | 400 |
| FOUR 2's, 3's or 4's | 40 | 80 | 120 | 160 | 200 |
| FOUR 5's THRU KINGS | 20 | 40 | 60 | 80 | 100 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

TOUCH SCREEN TO PICK ONE HAND,
PLAY STANDARD VIDEO POKER WITH THAT HAND

| | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR ACES | 80 | 160 | 240 | 320 | 400 |
| FOUR 2's, 3's or 4's | 40 | 80 | 120 | 160 | 200 |
| FOUR 5's THRU KINGS | 20 | 40 | 60 | 80 | 100 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

| | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR ACES | 80 | 160 | 240 | 320 | 400 |
| FOUR 2's, 3's or 4's | 40 | 80 | 120 | 160 | 200 |
| FOUR 5's THRU KINGS | 20 | 40 | 60 | 80 | 100 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

TOUCH SCREEN TO PICK ONE HAND,
PLAY STANDARD VIDEO POKER WITH THAT HAND

| | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR ACES | 80 | 160 | 240 | 320 | 400 |
| FOUR 2's, 3's or 4's | 40 | 80 | 120 | 160 | 200 |
| FOUR 5's THRU KINGS | 20 | 40 | 60 | 80 | 100 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

TOUCH SCREEN TO PICK ONE HAND,
PLAY STANDARD VIDEO POKER WITH THAT HAND

MULTIPLE PLAY PICK ONE POKER

CROSS-REFERENCE TO RELATED APPLICATION

This application is a Continuation-in-Part of application Ser. No. 09/056,898 entitled "Pick One Poker", filed Apr. 7, 1998, which is a Continuation of application Ser. No. 08/850,625 entitled "Pick One Poker", filed May 2, 1997, now U.S. Pat. No. 5,816,915.

FIELD OF THE INVENTION

This invention relates to a single player poker game, and more particularly to a single player poker game that can be played as an electronic video poker game or as a live table game and in which the player has the option to select one of four separate, initial hands. The four separate, initial hands can be dealt from a single deck of cards or from four separate decks of cards. The player then selects one of these four separate, initial hands to play and this hand is duplicated into the other three hand positions. The method of the present invention can be played as a casino wagering game or, alternatively, the method of the present invention can also be displayed on a non-wagering amusement device.

BACKGROUND OF THE INVENTION

There have been many types of electronic video gaming machines that have been developed. The electronic video poker gaming machine is designed to replicate the play of a hand of poker. Typically, the player is not playing against any other player's hands or against a dealer's hand; the player is simply attempting to achieve the highest ranking poker hand possible from the cards displayed to the player. The higher the ranking of the poker hand achieved by the player, the greater the player's winnings based on the number of coins, tokens or credits wagered by the player. Typically, a payout schedule is posted on the gaming machine to advise the player of the payoffs available for certain winning card combinations.

The forerunner of all electronic video poker gaming machines is the video Draw Poker machine that deals cards from a standard 52 card poker deck and displays a single five card hand to the player. The player then selects which of the five cards he wishes to hold (or discard depending on the format of the gaming machine). The draw poker machine then displays replacement cards for the cards the player has discarded. The player wins or loses based on conventional poker hand rankings for the resulting five card hand. In video Draw Poker, the conventional poker hand rankings that are winning combinations are a Royal Flush, a Straight Flush, a Four of a Kind, a Full House, a Flush, a Straight, a Three of a Kind, a Two Pair and a Pair of Jacks of Better. A payout table is established based on the number of coins wagered by the player and the type of poker hand achieved.

The classic draw poker machine has been modified to use jokers as wild cards or to use deuces (or even other cards) as wild cards. "Joker's Wild" and "Deuces Wild" draw poker still display to the player a single five card hand and allow the player to discard unwanted cards and receive replacement cards. The payout table is modified to recognize the differing odds for achieving various poker hands when wild cards are involved. Furthermore, different poker hand rankings are used in the pay table to recognize different winning combinations that can be achieved using wild cards.

U.S. Pat. No. 5,356,140 (the disclosure of which is incorporated herein by this reference) discloses a method of play of a game generally referred to as "Double Poker". In this method of play, a player makes a wager to participate in the game and the player is dealt two distinct hands at the beginning of the game. Each hand is dealt from its own separate complete deck of cards and all five cards in each hand are dealt face up. The player selects one of the hands to play and the unselected hand is voided or removed from use. The player plays out the selected hand according to the conventional manner of play of traditional video poker games by discarding and receiving replacement cards. All replacement cards are dealt from the particular initial deck of cards from which the first five cards were dealt. The player wins or loses based on a payout schedule applied to preselected winning hand combinations and based on the number of coins wagered by the player.

The method of play disclosed in this patent has the drawback that the player only has two initial five cards hands to choose from and all five cards of each hand are displayed to the player.

It is an object of the present invention to provide a new form of video poker game that gives the player many options as to which hand the player wishes to play during that particular round of the game.

It is a feature of the present invention to provide a multi-hand screen display which initially displays to the player four separate five card hands. Each of the four separate five card hands can be dealt from a separate deck of cards. Each hand is displayed with two cards face up and three cards face down. The player selects one of the sets of two face up cards to play. After the player has selected one of the sets of two face up cards to play, these two face up cards are duplicated into the other three hand positions in place of the initially dealt two face up cards in each hand. The face down cards in each hand are then revealed so that the player can see all five cards of each hand. The player then discards unwanted cards and receives replacement cards in each of the four hands. Each of the resulting final five card hands are compared to a payout schedule to determine if the player has achieved a winning hand combination.

It is an alternative feature of the present invention to provide a multi-hand screen display which initially displays to the player a plurality of separate five card hands; all of the hands being dealt from the same single deck of cards. Each hand is displayed with two cards face up and three cards face down. The player selects one of the sets of two face up cards to play. After the player has selected one of the sets of two face up cards to play, these two face up cards are duplicated into the other three hand positions in place of the initially dealt face up cards in each hand. The face down cards in each hand are then revealed so that the player can see all five cards of each hand. All of the non-selected cards are returned to the deck and reshuffled to be used as possible replacement cards during the draw. The player then discards unwanted cards and receives replacement cards in each of the four hands. Each of the resulting final five card hands are compared to a payout schedule to determine if the player has achieved a winning hand combination.

It is still a further feature of the present invention to provide special bonus payouts based on the cards revealed during the initial deal of the game. For example, if the initial cards that are face up comprise eight, seven or six Aces or eight, seven, six or five card Royal Flushes, the player can be paid a large jackpot payout.

It is an advantage of the present invention that the player is given multiple options at the beginning of the game to select what the player perceives is the best possible and potential hand.

It is a further advantage of the present invention that the player is provided multiple initial starting hands so that the player has the opportunity to maximize his winnings when he is dealt a good starting hand.

Other objects, features and advantages of the present invention will become apparent from a consideration of the following detailed description.

SUMMARY OF THE INVENTION

An electronic video draw poker machine is provided with a multi-hand screen display that can show a plurality of five card draw poker hands at the same time. In the preferred embodiment, four separate five card draw poker hands are displayed. A separate five card poker hand is displayed in each quadrant of the screen display with each five card hand being dealt from its associated, separate deck of playing cards. In the preferred embodiment of the present invention, the initial deal of each five card hand is two cards face up and three cards face down. The player selects one of the sets of two face up cards to continue play. After the player has selected which set of two face up cards he wishes to play, the selected two face up cards are duplicated into the other three hand positions to replace the two face up cards in that hand position. The remaining face down cards in each hand are then revealed. The game then continues in the conventional manner with the player discarding and drawing replacement cards with respect to each of the four separate five card hands in an attempt to improve each hand. After the draw step is completed, each of the final five card hands are compared to a pay table based on poker hand ranking to determine if the player has achieved a winning combination. The amount of the payout to the player for a winning combination is based on the number of coins, tokens or credits wagered by the player and the type of winning hand achieved.

Alternatively, instead of using separate decks of playing cards for each hand, all of the initial hands can be dealt from a single deck of playing cards. After the player selects which of the initial hands the player wishes to play, all of the cards from the non-selected hands are returned to the deck to be available as possible replacement cards during the draw step.

DETAILED DESCRIPTION OF THE PREFERRED EMBODIMENTS

Figure 1:
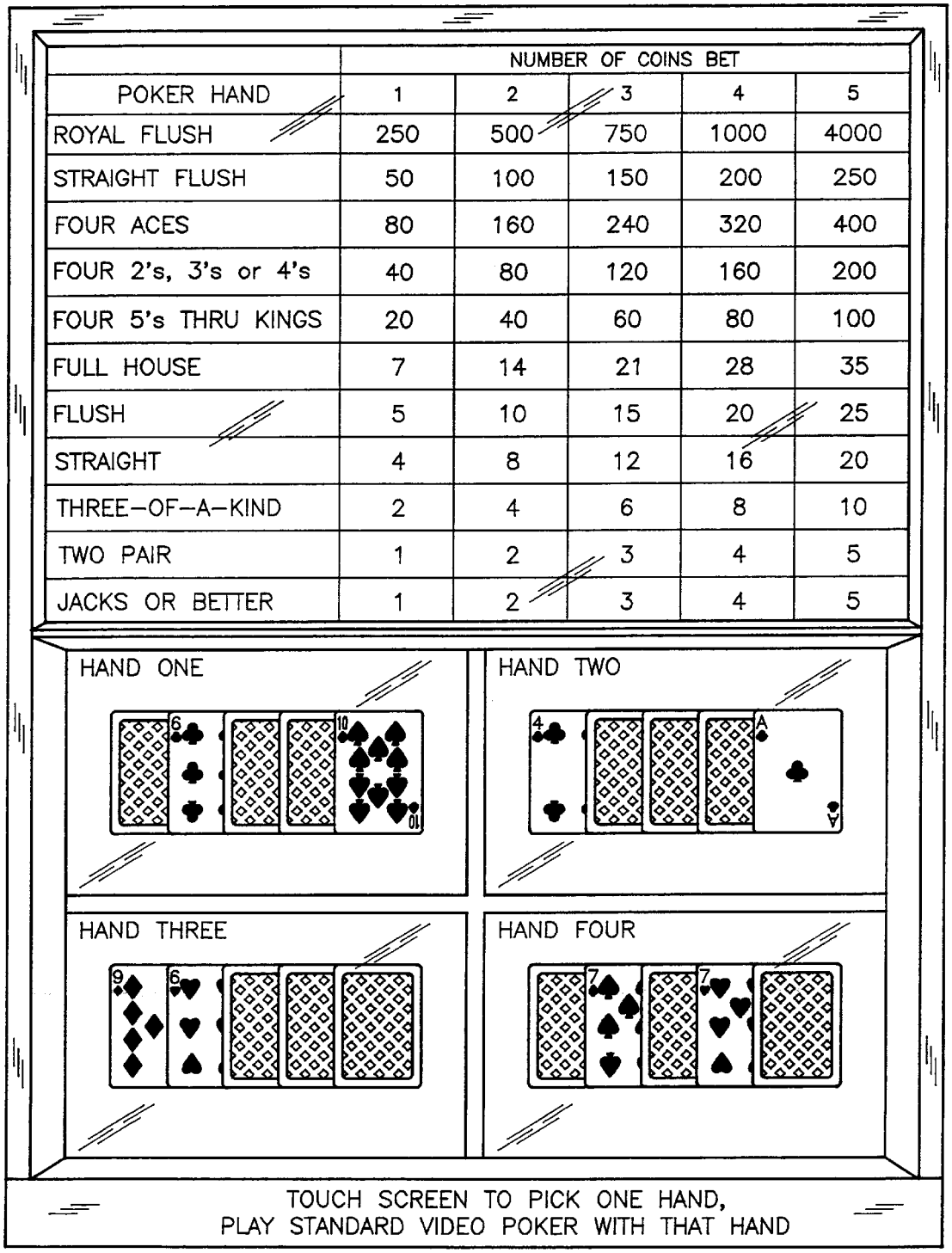
FIG. 1 shows a typical screen display and payout table used in the method of the present invention.

FIG. 1 shows the screen display for an electronic video poker machine programmed to operate in accordance with the method of play in the present invention.

As is conventional in gaming machines of this type, a player wagers one or more coins, tokens, paper currency or credits to activate the game. A coin acceptor or a currency acceptor is provided as is conventional to allow the player to insert coins, tokens or currency to activate the game. In addition to using coin/token acceptor mechanisms or currency acceptor mechanisms or both, the method of the present invention is intended to also include credit coupons, credit or debit card systems, magnetically or optically read memory storage cards or any other apparatus or system by which monetary value can be input by the player and eventually displayed on the credit display on the gaming machine.

Also as is conventional, the screen display can include a credit meter which accrues credits available to the player to play the game and which accrues credits won by the player during the play of the game. When the player wins an award or otherwise decides to stop playing the game, the player is paid his accrued winnings either by means of a coin hopper that dispenses coins or tokens to the player or any of the other myriad devices and apparatus that are available to pay a winning player. The amusement version of the method of play would not require a wager to be made in order to play the game.

In this embodiment of the present invention, the screen display is divided into four quadrants in which the four initially dealt hands, designated as HAND ONE, HAND TWO, HAND THREE and HAND FOUR, respectively, are displayed. Four standard decks of playing cards are used; each of the four hands being associated with one of the four decks. After each of the four separate decks are electronically shuffled, an initial five card hand is dealt from each separate deck of playing cards and displayed in each of the quadrants of the screen display. For example, HAND ONE is dealt from Deck #1, HAND TWO is dealt from Deck #2, HAND THREE is dealt from Deck #3 and HAND FOUR is dealt from Deck #4.

As shown in FIG. 1, each five card hand has two cards dealt face up and the other three cards dealt face down. Which of the particular cards are face up or face down is not critical, as long as in this preferred embodiment each hand has two cards face up and three cards face down. Other embodiments of the present invention can utilize a different number of face up cards and face down cards: such as three cards face up—two cards face down; or four cards face up and one card face down; or one card face up and four cards face down. However, the most preferred embodiment of the present invention is as shown in FIG. 1 in which each hand has two cards face up and three cards face down.

After the initial deal of these four separate hands, the player selects which one of the four hands the player wishes to play for that round of play. This selection can be accomplished by pressing an appropriate button provided on a conventional button panel on the cabinet of the gaming machine or by simply pressing the screen at the location of the desired hand, using conventional touch screen technology that is widely available in gaming devices of this type.

After the player has selected one of the hands to play, the three face down cards in the selected hand are turned face up and displayed to the player. In the preferred embodiment of the present invention, the other three non-selected hands will be removed from the screen display and the selected hand will be re-displayed in the center of the screen using larger card displays to make it easier for the player to see the cards. However, it is also within the scope of the present invention to simply leave the non-selected hands on the screen display as inactive hands.

The player then selects which, if any, of the five cards he wishes to discard. Again this can be accomplished by pressing the appropriate "Hold" buttons as are conventional in electronic video poker gaming machines or by simply pressing the screen at the location of the cards which the player desires to hold using conventional touch screen technology. (The gaming machine can also be configured to provide "Discard" buttons instead of "Hold" buttons whereby the player presses the "Discard" buttons corresponding to the cards the player wishes to discard or the touch screen can be configured so that the cards that the player touches are discarded instead of held. However, the convention currently in use in the electronic video poker gaming machine industry is to have the player select which cards he wishes to hold, not which cards he wishes to discard).

The player activates the "Draw" button to receive replacement cards for the discarded cards, as is conventional in electronic video poker. In this embodiment of the present invention, the replacement cards are dealt using the same fifty-two card deck from which the initial five cards were dealt and that corresponds to the hand selected by the player. For example, if the player has selected HAND ONE to play, the replacement cards are dealt from Deck #1.

After the replacement cards are displayed to the player, the resulting five card is used to determine whether the player has a winning or losing hand based on poker hand rankings as shown in the payout table.

Just above the screen display is the payout table which shows the winning hand combinations and the amount of the payout to the player based on the number of coins, tokens or credits wagered by the player. In the preferred embodiment of the present invention, a conventional video poker payout table can be used as shown in Table 1.

TABLE 1

| | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR ACES | 80 | 160 | 240 | 320 | 400 |
| FOUR 2's, 3's or 4's | 40 | 80 | 120 | 160 | 200 |
| FOUR 5's THRU KINGS | 20 | 40 | 60 | 80 | 100 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

Alternatively, other payout tables can be utilized depending on the percentages the house wishes to retain.

With reference to FIG. 1, the player would most likely select HAND FOUR since this is the best poker hand showing a pair of Sevens.

The game can be applied to any variation of draw poker or stud poker, such as regular Draw Poker, Deuces Wild Poker, Bonus Poker, Double Bonus Poker, Double Double Bonus Poker, Triple Bonus and the like. Each of these video poker variations uses various arrangements of poker hand rankings as winning combinations. Wild cards can be added to the decks so that Joker's Wild or Deuce's Wild can be played. The game can be played in a live game version or an electronic video gaming machine can be programmed to display the game and provide the payouts to the player.

Other modifications of the present invention would include displaying three hands to the player and revealing either two or three cards face up prior to the time the player selects which of the three hands to play. Alternatively, two hands could be displayed to the player with either two or three cards being displayed face up prior to the time the player selects which of the two hands to play.

In accordance with the preferred embodiment of the present invention, when screen displays having four hands initially displayed to the player are used, no more than two cards of each hand should be displayed to the player prior to the player making his selection of which of the four hands he wishes to play. If more than two cards are displayed face up, the play of the game is affected since showing more than two cards face up creates a game that is more favorable to the player than to the house if conventional pay tables are used.

Likewise, for screen displays having two or three hands initially displayed to the player, no more than three cards of each hand should be displayed to the player prior to the player making his selection of which hand to play. In this embodiment, if more than three cards are shown face up, a game that is more favorable to the player than to the house is created if conventional pay tables are used.

Alternatively, the initial hands displayed to the player can be displayed as partial hands without showing the cards that are face down. In this embodiment of the present invention, only the face up cards are shown. For example, HAND ONE would be shown with only two face up cards, HAND TWO would be shown with only two face up cards, HAND THREE would be shown with only two face up cards and HAND FOUR would be shown with only two face up cards. The player would then select one of the partial hands as the hand the player wishes to play. The selected partial hand would then be completed by dealing the remaining three cards face up. The play of the hand would then continue in the manner described above with the player discarding unwanted cards and receiving replacement cards for the discarded cards.

In another alternative embodiment of the present invention in which all of the plurality of hands are dealt from a single deck, after the player selects one of the hands to play, the cards from the non-selected hands are returned to the deck and reshuffled into the deck in order to be available as replacement cards during the draw step. For example, with reference again to FIG. 1, if the player selects to play HAND ONE, all of the cards from HAND TWO, HAND THREE and HAND FOUR are returned to deck and are reshuffled into the deck so as to be available as replacement cards during the draw step. The method of play then continues as described above. The player selects which cards to hold (or to discard) and replacement cards are displayed from the reshuffled deck for the cards discarded.

The method of the present invention can also include special bonus payouts based on various card combinations occurring during the play of the game.

Figure 2:
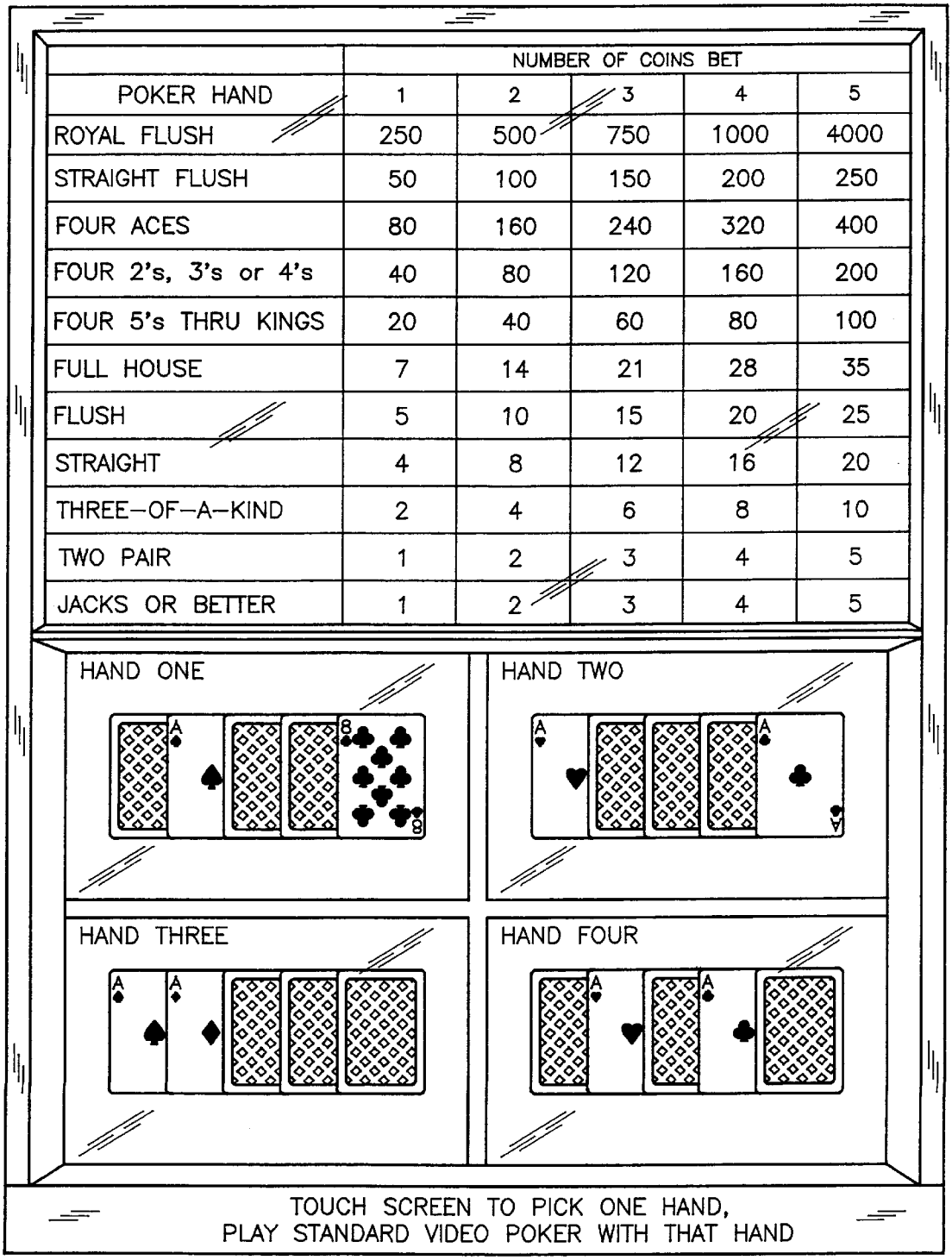
FIG. 2 shows a screen display and payout table used in the method of the present invention including an example of an initial deal which would pay the player for achieving a bonus payout.

In one preferred embodiment of the special bonus payouts, the initially displayed face up cards are used to determine the winning bonus combinations. With reference to FIG. 2, eight cards are shown face up when the initial four hands are dealt. The player can be awarded a special bonus payout if these eight cards are a pre-established winning combination. Any suitable winning combination of the initial eight cards can be used.

In the preferred embodiment of the present invention in which each hand is dealt from a separate deck of cards, a special bonus payout can be paid if some number (such as five, six, seven or even eight) of the initial eight face up cards are all of the same card rank (such as Aces, Kings, or the like) or if the player is dealt is two Four of a Kinds or other card combinations. For example, as shown in FIG. 2, the initial deal has eight face up cards among the four hands initially dealt. Seven of the eight face up cards are Aces, and the player can be awarded a special bonus payout for being dealt seven Aces on the initial deal. The amount of the special bonus payout is based on the mathematical probability of the winning combination occurring. Any suitable winning combination can be used for the special bonus payout.

In the preferred embodiment of the present invention in which a single common deck of cards is used to deal all of the plurality of hands, a special bonus payout can also be paid for certain pre-established winning combinations. An example of one such pre-established winning combination would be a five card Royal Flush occurring in the initial eight face up cards. Alternatively, the winning combination can be a six card Royal Flush (Ace through Nine of the same suit), a seven card Royal Flush (Ace through Eight of the same suit) or even an eight card Royal Flush (Ace through Seven of the same suit). Other suitable pre-established winning combinations that can be formed from a single deck of playing cards with or without one or more Jokers can be used.

The amount of the special bonus payout can be either a fixed jackpot amount or a progressive jackpot amount. When the amount of the special bonus payout is a fixed jackpot amount, it can be a multiple of the number of coins, tokens or credits wagered by the player to participate in the play of the game. For example, if the winning combination of the initial eight face up cards is a five card Royal Flush, the player can be paid a fixed jackpot amount of 25 coins for each coin wagered (with an increased payout of 400 coins for making the maximum wager of five coins to encourage the player to wager the maximum amount during the play of the game). Multiple winning combinations can be designated with all of the winning combinations being fixed payouts, all of the winning combinations being progressive payouts or a mixture of fixed and progressive payouts.

Another variation of the method of play of the present invention, which is to be called Pick 144 Poker, involves duplicating cards from the initial hand selected by the player into the other three hands. The method of play of this variation is shown in FIGS. 3–7.

In order to participate in a round of Pick 144 Poker, a player makes a wager. In the preferred embodiment of this variation, the player would make a wager to be allocated to each of the four hands that will be dealt to the player. The player would use coins or tokens inserted into a coin head on the gaming machine, or insert paper currency into a bill acceptor on the gaming machine or use previously accrued credits to make his wager. As is conventional in electronic video draw poker machines, the player would wager between one and five credits for each hand, although the maximum number of credits per hand could be any amount. Assuming that five credits was the maximum wager on each hand, the player would wager twenty credits to make the maximum bet to play all four hands. In the preferred embodiment of this variation, the player would be required to play all four hands, although the gaming machine could be configured to allow the player to play either one, two, three or all four hands if the player so desired.

Figure 3:
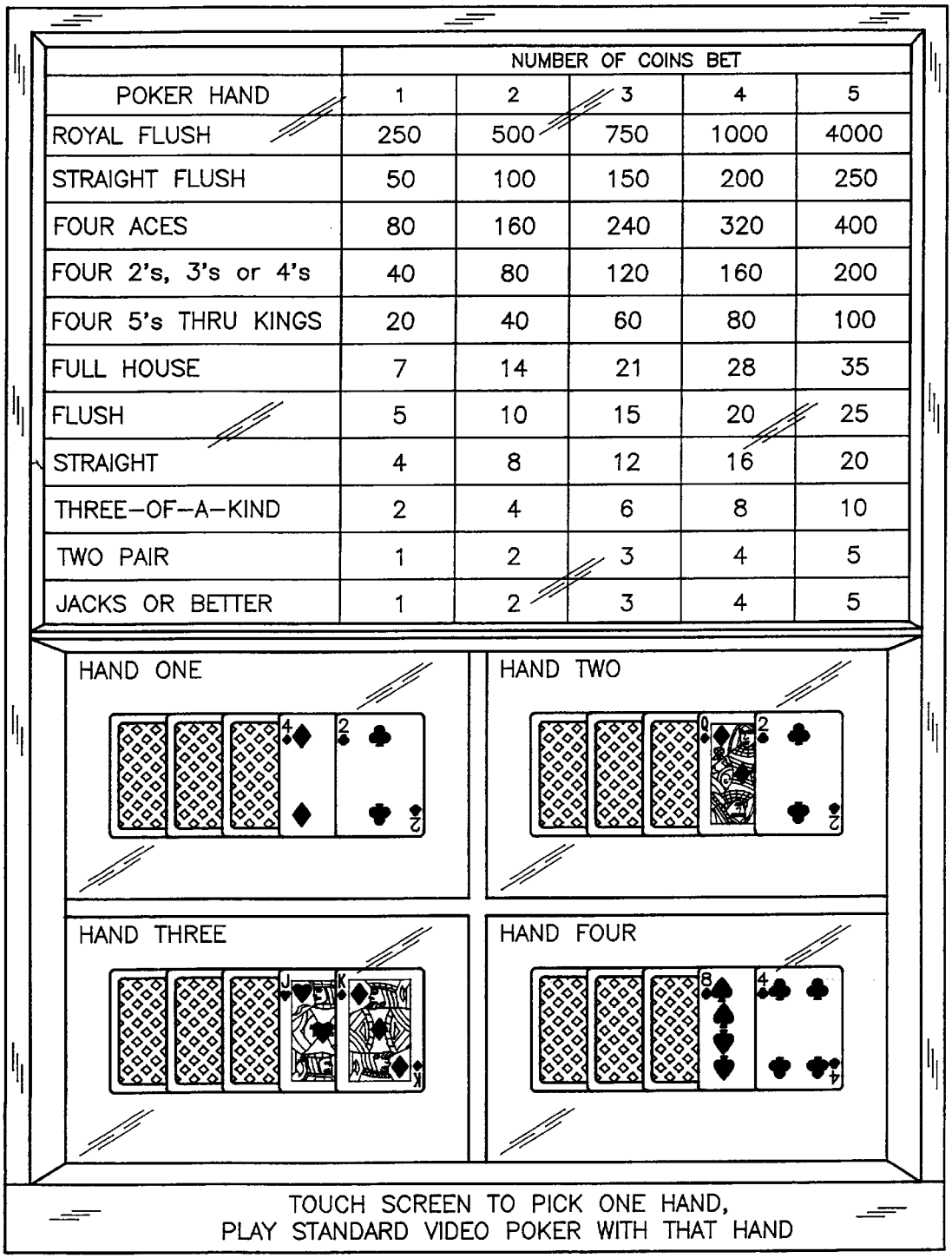
FIG. 3 shows the initial screen display and payout table of an alternative embodiment of the present invention which duplicates the initial hand selected by the player into the other hand positions.

With regard to the example shown in FIG. 3, the player has made the maximum wager of five credits on each of the four hands so the player has made a total wager of twenty credits. The computer controls of the gaming machine, after completing a shuffling of the cards, has displayed the initial four hands to the player. Each hand is dealt with five cards. In the preferred embodiment of this variation, each hand has two cards face up and three cards face down, although more or less than two cards can be dealt face up. Again, in the preferred embodiment of this variation, each hand is dealt from its own distinct deck of playing cards, although it is also possible to practice this variation by dealing all four hands from a single deck of playing cards.

With reference to the example shown in FIG. 3, Hand One has received three cards face down and two cards face up—the Four♦ and the Two♣; Hand Two has received three cards face down and two cards face up—the Queen♦ and the Two♣; Hand Three has received three cards face down and two cards face up—the Jack♥ and the King♦; and Hand Four has received three cards face down and two cards face up—the Eight♠ and the Four♣.

Figure 4:
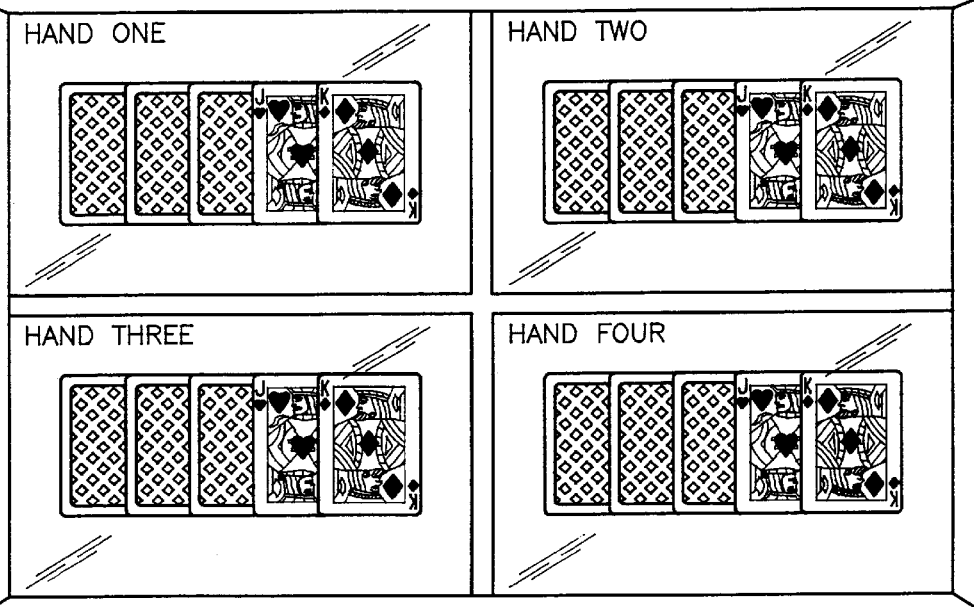
FIG. 4 shows a screen display of the alternative embodiment of the present invention after the player has selected one of the initial hands and that hand has been duplicated into the other hand positions.

The player now selects one of the sets of the two face up cards as the face up cards that the player wishes to play and the two face up cards so selected are duplicated into the other four hands as replacement cards for the two face up cards initially dealt in each hand. As shown in FIG. 4, the player has selected the two face up cards from initial Hand 3 and these two face up cards—the Jack♥ and the King♦ have been duplicated into the other three hands as replacement cards for the two face up cards initially dealt in these hands.

The three remaining face down cards in each of the four hands are now revealed and the player is shown all five cards in each of the four hands.

Figure 5:
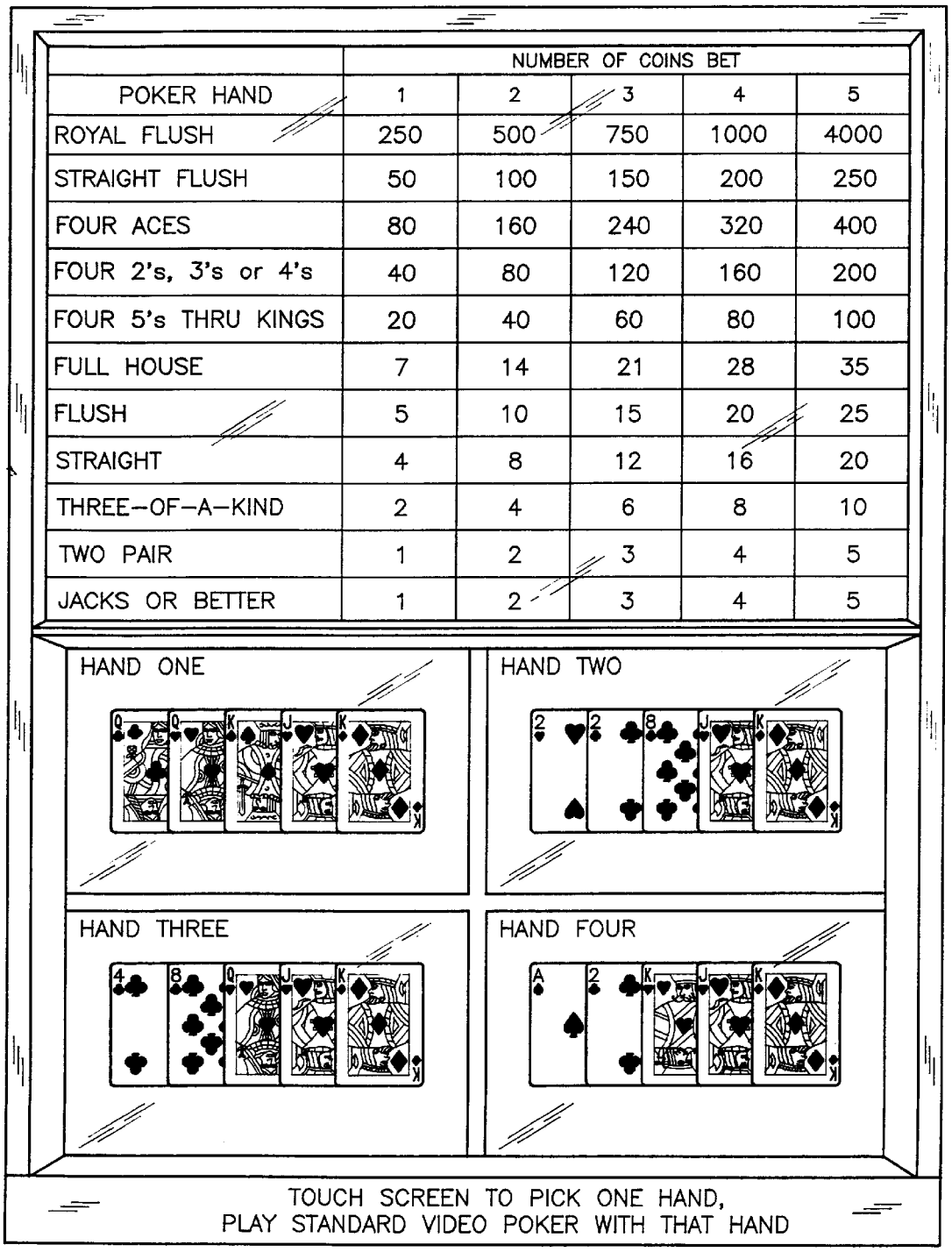
FIG. 5 shows the screen display and payout table of an alternative embodiment of the present invention after all five cards have been revealed in the four hand positions.

As shown in the example in FIG. 5, the player now has four hands to play. Hand One now contains the Queen♣, Queen♥, King♠, Jack♥ and King♦. Hand Two now contains the Two♥, Two♣, Eight♣, Jack♥ and King♦. Hand Three now contains the Four♣, Eight♣, Queen♥, Jack♥ and King♦. Hand Four now contains the Ace♠, Two♣, King♥, Jack♥ and King♦.

The player is now provided with the opportunity to hold any cards and discard any other cards from each of the four hands as would be conventional in draw poker. Each hand is played individually.

Figure 6:
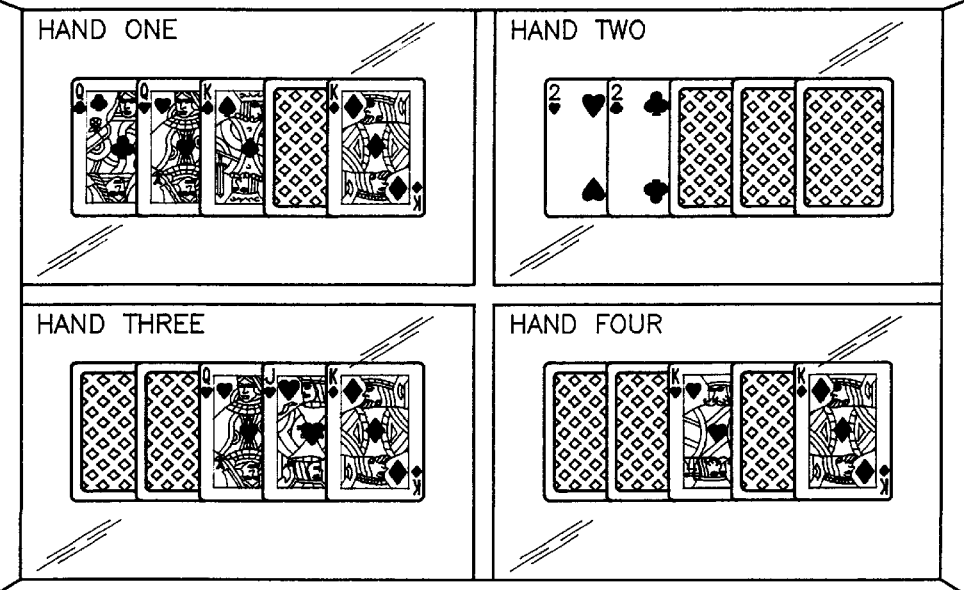
FIG. 6 shows the screen display and payout table of an alternative embodiment of the present invention showing which cards the player has selected to hold in each of the four hand positions.

FIG. 6 show for example, that the player has held in Hand One the Queen♣, Queen♥, King♠ and King♦ and discarded the Jack♥. In Hand Two the player has held the Two♥ and Two♣ and discarded the Eight♣, Jack♥ and King♦. In Hand Three, the player has held the Queen♥, Jack♥ and King♦ and discarded the Four♣ and Eight♣. Finally in Hand Four, the player has held the King♥ and King♦ and discarded the Ace♠, Two♣ and Jack♥. Replacement cards for the discarded cards are dealt to each hand.

After the replacement cards have been dealt, each replacement card is turned face up to reveal the final five card hand of each of the four hands. The final five card hand in each of the four hands is analyzed to determine its poker hand ranking and compared to a pay table to determine if the hand is a winning or losing hand. Winning hands are paid based on the poker hand ranking and the number of coins, tokens or credits wagered by the player on that hand.

Figure 7:
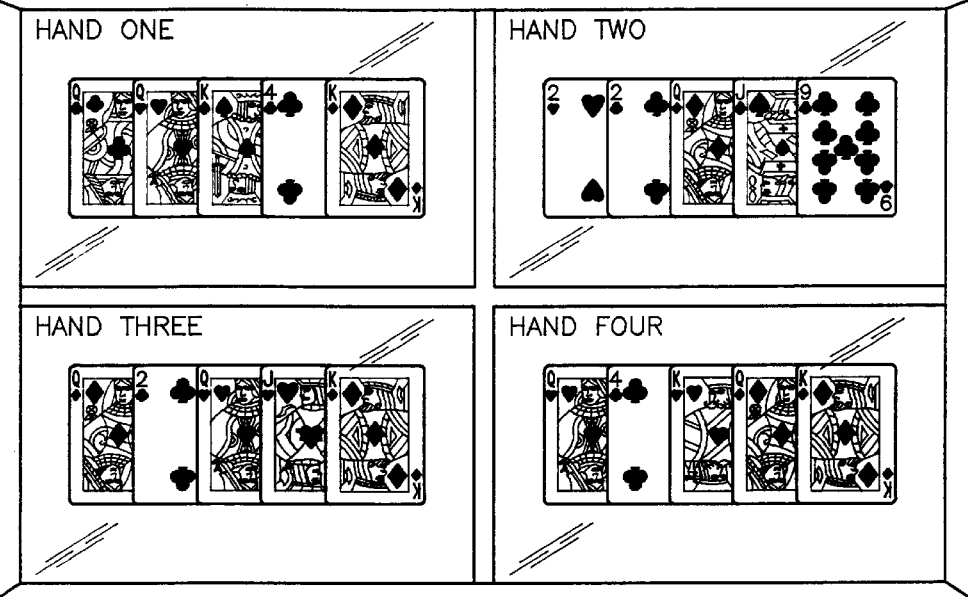
FIG. 7 shows the screen display and payout table of an alternative embodiment of the present invention after replacement cards have been dealt for the discarded cards in each of the four hand positions.

For example, FIG. 7 shows the final five card hand of each of the four hands after the replacement cards have been revealed. In Hand One, the player has achieved Two Pair and would be paid 10 credits for a wager of 5 credits as shown in Table 1. In Hand Two, the player has a single Pair and this is a losing hand. In Hand Three and Hand Four, the player has also achieved Two Pair and would be paid 10 credits for a wager of 5 credits on each of these hands.

Variations may be made to this alternative embodiment of the present invention. Instead of dealing all five cards initially to each of the four hands, the initial deal may be dealt with only the face up cards. For example, with regard to the FIG. 3, the initial deal may only show the two face up cards in each of the four hands. The player would then select one of the two card hands to be duplicated into the other three hands and then the deal is completed by adding three more cards to each hand.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a draw poker game comprising:

a) dealing a player a first five card hand from a first deck of playing cards with two cards face up and three cards face down;

b) dealing the player a second five card hand from a second deck of playing cards with two cards face up and three cards face down;

c) dealing the player a third five card hand from a third deck of playing cards with two cards face up and three cards face down;

d) dealing the player a fourth five card hand from a fourth deck of playing cards with two cards face up and three cards face down;

e) the player selecting the two face up cards from one of the hands;

f) duplicating the two face up cards selected by the player as replacement cards for the two face up cards in each of the other hands;

g) revealing the face down cards in each hand;

h) with regard to each of the first hand, the second hand, the third hand and the fourth hand, the player either standing on the hand or discarding one or more cards from the hand;

i) with regard to each of the first hand, the second hand, the third hand and the fourth hand, dealing the player replacement cards for the discarded cards, if any;

j) with regard to each of the first hand, the second hand, the third hand and the fourth hand, determining the poker hand ranking of the hand; and k) with regard to each of the first hand, the second hand, the third hand and the fourth hand, awarding the player a predetermined amount based on the poker hand ranking of the hand.

2. The method of claim 1 in which each deck of playing cards is a standard 52 card deck.

3. The method of claim 1 in which each deck of playing cards is a standard 52 card deck plus at least one extra Joker card which is treated as a wild card.

4. The method of claim 1 in which each deck of playing cards is a standard 52 card deck with at least one of the cards being treated as a wild card.

5. The method of claim 1 in which the predetermined amount awarded to the player is based on a payout schedule and is based on an amount wagered by the player.

6. The method of claim 5 in which the payout schedule is as follows:

| | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR ACES | 80 | 160 | 240 | 320 | 400 |
| FOUR 2's, 3's or 4's | 40 | 80 | 120 | 160 | 200 |
| FOUR 5's THRU KINGS | 20 | 40 | 60 | 80 | 100 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5. |

7. The method of claim 1 further including a player wagering at least one coin to be eligible to participate in the game.

8. The method of claim 7 in which the predetermined amount awarded to the player is based on the number of coins wagered by the player.

9. The method of claim 1 in which the game is displayed on a video display screen on an electronic gaming machine.

10. A method of playing a draw poker game comprising:

a) dealing a player at least two five card hands, each five card hand being dealt from its own deck of playing cards and each five card hand being dealt with two cards face up and three cards face down;

b) the player selecting the two face up cards from one of the hands;

c) duplicating the two face up cards selected by the player as replacement cards for the two face up cards in each of the other hands;

d) revealing the face down cards in each hand;

e) with regard to each hand, the player either standing on the hand or discarding one or more cards from the hand;

f) with regard to each hand, dealing the player replacement cards for the discarded cards, if any;

g) with regard to each hand, determining the poker hand ranking of the hand; and h) with regard to each hand, awarding the player a predetermined amount based on the poker hand ranking of the hand.

11. A method of playing a draw poker game comprising:

a) dealing a player at least two partial hands, each partial hand being dealt from its own deck of playing cards and each partial hand being dealt with two cards face up;

b) the player selecting the two face up cards from one of the partial hands;

c) duplicating the two face up cards selected by the player as replacement cards for the two face up cards in the other hands;

d) dealing three additional cards to each hand and displaying the additional cards face up;

e) with regard to each hand, the player either standing on the hand or discarding one or more cards from the hand;

f) with regard to each hand, dealing the player replacement cards for the discarded cards, if any;

g) with regard to each hand, determining the poker hand ranking of the hand; and h) with regard to each hand, awarding the player a predetermined amount based on the poker hand ranking of the hand.

* * * * *